US006793328B2

(12) United States Patent
Jeanmaire

(10) Patent No.: US 6,793,328 B2
(45) Date of Patent: Sep. 21, 2004

(54) CONTINUOUS INK JET PRINTING APPARATUS WITH IMPROVED DROP PLACEMENT

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 93 days.

(21) Appl. No.: 10/100,376

(22) Filed: Mar. 18, 2002

(65) Prior Publication Data

US 2003/0174190 A1 Sep. 18, 2003

(51) Int. Cl.[7] ..... B41J 2/07
(52) U.S. Cl. ..... 347/74
(58) Field of Search ..... 347/73–74, 76, 347/81, 80, 90, 75–77, 6; 239/4, 102.1, 659, 225.1, 652

(56) References Cited

U.S. PATENT DOCUMENTS

| | | | | |
|---|---|---|---|---|
| 1,941,001 A | | 12/1933 | Hansell | 178/96 |
| 3,373,437 A | | 3/1968 | Sweet et al. | 347/74 |
| 3,416,153 A | | 12/1968 | Hertz et al. | 347/73 |
| 3,709,432 A | | 1/1973 | Robertson | 239/4 |
| 3,878,519 A | | 4/1975 | Eaton | 347/75 |
| 4,190,844 A | | 2/1980 | Taylor | 347/82 |
| 4,346,387 A | | 8/1982 | Hertz | 347/75 |
| 4,346,389 A | * | 8/1982 | Nagayama | 347/76 |
| 4,491,852 A | * | 1/1985 | Jinnai | 347/76 |
| 4,638,382 A | | 1/1987 | Sochor | 360/68 |
| 4,914,522 A | | 4/1990 | Duffield et al. | 358/296 |
| 4,990,932 A | * | 2/1991 | Houston | 347/81 |
| 5,224,843 A | | 7/1993 | van Lintel | 417/413.2 |
| 6,079,821 A | | 6/2000 | Chwalek et al. | 347/82 |
| 6,443,350 B2 | * | 9/2002 | Farnworth | 228/33 |
| 6,517,197 B2 | * | 2/2003 | Hawkins et al. | 347/74 |

* cited by examiner

*Primary Examiner*—K. Feggins
(74) *Attorney, Agent, or Firm*—Milton S. Sales; Mark G. Bocchetti

(57) ABSTRACT

An apparatus for printing an image is provided. In this apparatus, each nozzle is operable to selectively create a stream of ink droplets having a plurality of volumes. The apparatus also includes a droplet deflector having a gas source. The gas source is positioned at an angle with respect to the stream of ink droplets and is operable to interact with the stream of ink droplets thereby separating ink droplets into printing and non-printing paths. Additionally, the apparatus includes a means for improving drop placement on the receiver media by making small adjustments to the volumes of the printing droplets.

20 Claims, 5 Drawing Sheets

CONTINUOUS INK JET PRINTING APPARATUS WITH IMPROVED DROP PLACEMENT

CROSS REFERENCE TO RELATED APPLICATIONS

Reference is made to commonly assigned, co-pending U.S. patent application Ser. No. 09/750,946 and Ser. No. 09/751,232, both filed in the names of David L. Jeanmaire and James M. Chwalek on Dec. 28, 2000.

FIELD OF THE INVENTION

This invention relates generally to the field of digitally controlled printing devices, and in particular to continuous ink jet printers wherein a liquid ink stream breaks into droplets, some of which are selectively deflected.

BACKGROUND OF THE INVENTION

Traditionally, digitally controlled color ink jet printing capability is accomplished by one of two technologies. The first technology, commonly referred to as "drop-on-demand" ink jet printing, typically provides ink droplets for impact upon a recording surface using a pressurization actuator (thermal, piezoelectric, etc.). Selective activation of the actuator causes the formation and ejection of a flying ink droplet that crosses the space between the print head and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

With thermal actuators, a heater, located at a convenient location, heats the ink causing a quantity of ink to phase change into a gaseous steam bubble. This increases the internal ink pressure sufficiently for an ink droplet to be expelled. The bubble then collapses as the heating element cools, and the resulting vacuum draws fluid from a reservoir to replace ink that was ejected from the nozzle.

Piezoelectric actuators, such as that disclosed in U.S. Pat. No. 5,224,843, issued to vanLintel on Jul. 6, 1993, have a piezoelectric crystal in an ink fluid channel that flexes when an electric current flows through it forcing an ink droplet out of a nozzle. The most commonly produced piezoelectric materials are ceramics, such as lead zirconate titanate, barium titanate, lead titanate, and lead metaniobate.

In U.S. Pat. No. 4,914,522, which issued to Duffield et al. on Apr. 3, 1990, a drop-on-demand ink jet printer utilizes air pressure to produce a desired color density in a printed image. Ink in a reservoir travels through a conduit and forms a meniscus at an end of an ink nozzle. An air nozzle, positioned so that a stream of air flows across the meniscus at the end of the nozzle, causes the ink to be extracted from the nozzle and atomized into a fine spray. The stream of air is applied for controllable time periods at a constant pressure through a conduit to a control valve. The ink dot size on the image remains constant while the desired color density of the ink dot is varied depending on the pulse width of the air stream.

The second technology, commonly referred to as "continuous stream" or "continuous" ink jet printing, uses a pressurized ink source that produces a continuous stream of ink droplets. Conventional continuous ink jet printers utilize electrostatic charging devices that are placed close to the point where a filament of ink breaks into individual ink droplets. The ink droplets are electrically charged and then directed to an appropriate location by deflection electrodes. When no print is desired, the ink droplets are directed into an ink-capturing mechanism (often referred to as catcher, interceptor, or gutter). When print is desired, the ink droplets are directed to strike a print media.

Typically, continuous ink jet printing devices are faster than drop-on-demand devices and produce higher quality printed images and graphics. However, each color printed requires an individual droplet formation, deflection, and capturing system.

U.S. Pat. No. 1,941,001, issued to Hansell on Dec. 26, 1933, and U.S. Pat. No. 3,373,437 issued to Sweet et al. on Mar. 12, 1968, each disclose an array of continuous ink jet nozzles wherein ink droplets to be printed are selectively charged and deflected towards the recording medium. This technique is known as binary deflection continuous ink jet.

U.S. Pat. No. 3,416,153, issued to Hertz et al. on Oct. 6, 1963, discloses a method of achieving variable optical density of printed spots in continuous ink jet printing using the electrostatic dispersion of a charged droplet stream to modulate the number of droplets which pass through a small aperture.

U.S. Pat. No. 3,878,519, issued to Eaton on Apr. 15, 1975, discloses a method and apparatus for synchronizing droplet formation in a liquid stream using electrostatic deflection by a charging tunnel and deflection plates.

U.S. Pat. No. 4,346,387, issued to Hertz on Aug. 24, 1982, discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

U.S. Pat. No. 4,638,382, issued to Drake et al. on Jan. 20, 1987, discloses a continuous ink jet print head that utilizes constant thermal pulses to agitate ink streams admitted through a plurality of nozzles in order to break up the ink streams into droplets at a fixed distance from the nozzles. At this point, the droplets are individually charged by a charging electrode and then deflected using deflection plates positioned the droplet path.

As conventional continuous ink jet printers utilize electrostatic charging devices and deflector plates, they require many components and large spatial volumes in which to operate. This results in continuous ink jet print heads and printers that are complicated, have high energy requirements, are difficult to manufacture, and are difficult to control.

U.S. Pat. No. 3,709,432, issued to Robertson on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitude stimulations resulting in longer filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

While this method does not rely on electrostatic means to affect the trajectory of droplets, it does rely on the precise control of the break up points of the filaments and the placement of the air flow intermediate to these break up points. Such a system is difficult to control and to manufacture. Furthermore, the physical separation or amount of discrimination between the two droplet paths is small, further adding to the difficulty of control and manufacture.

U.S. Pat. No. 4,190,844, issued to Taylor on Feb. 26, 1980, discloses a continuous ink jet printer having a first pneumatic deflector for deflecting non-printed ink droplets to a catcher and a second pneumatic deflector for oscillating printed ink droplets. A print head supplies a filament of working fluid that breaks into individual ink droplets. The ink droplets are then selectively deflected by a first pneumatic deflector, a second pneumatic deflector, or both. The first pneumatic deflector is an "ON/OFF" type having a diaphragm that either opens or closes a nozzle depending on one of two distinct electrical signals received from a central control unit. This determines whether the ink droplet is to be printed or non-printed. The second pneumatic deflector is a continuous type having a diaphragm that varies the amount that a nozzle is open, depending on a varying electrical signal received the central control unit. This oscillates printed ink droplets so that characters may be printed one character at a time. If only the first pneumatic deflector is used, characters are created one line at a time, being built up by repeated traverses of the print head.

While this method does not rely on electrostatic means to affect the trajectory of droplets, it does rely on the precise control and timing of the first ("ON/OFF") pneumatic deflector to create printed and non-printed ink droplets. Such a system is difficult to manufacture and accurately control, resulting in at least the ink droplet build up discussed above. Furthermore, the physical separation or amount of discrimination between the two droplet paths is erratic due to the precise timing requirements, increasing the difficulty of controlling printed and non-printed ink droplets and resulting in poor ink droplet trajectory control.

Additionally, using two pneumatic deflectors complicates construction of the print head and requires more components. The additional components and complicated structure require large spatial volumes between the print head and the media, increasing the ink droplet trajectory distance. Increasing the distance of the droplet trajectory decreases droplet placement accuracy and affects the print image quality. Again, there is a need to minimize the distance that the droplet must travel before striking the print media in order to insure high quality images.

U.S. Pat. No. 6,079,821, issued to Chwalek et al. on Jun. 27, 2000, discloses a continuous ink jet printer that uses actuation of asymmetric heaters to create individual ink droplets from a filament of working fluid and to deflect those ink droplets. A print head includes a pressurized ink source and an asymmetric heater operable to form printed ink droplets and non-printed ink droplets. Printed ink droplets flow along a printed ink droplet path ultimately striking a receiving medium, while non-printed ink droplets flow along a non-printed ink droplet path ultimately striking a catcher surface. Non-printed ink droplets are recycled or disposed of through an ink removal channel formed in the catcher. While the ink jet printer disclosed in Chwalek et al. works extremely well for its intended purpose, it is best adapted for use with inks that have a large viscosity change with temperature.

Each of the above-described ink jet printing systems has advantages and disadvantages. However, print heads which are low-power and low-voltage in operation will be advantaged in the marketplace, especially in page-width arrays. Commonly assigned, co-pending U.S. patent application Ser. No. 09/750,946 and Ser. No. 09/751,232, both filed in the names of David L. Jeanmaire and James M. Chwalek on Dec. 28, 2000, disclose continuous-jet printing wherein nozzle heaters are selectively actuated at a plurality of frequencies to create the stream of ink droplets having the plurality of volumes. A gas stream provides a force separating droplets into printing and non-printing paths according to drop volume. This process consumes little power, and is suitable for printing with a wide range of inks. However, the apparatus can have difficulty with registration of the ink droplets on the print media, due in part to slight deviations in the jet directions, and in part to slight variation in the gas flow velocity experienced by each droplet stream from jet to jet. Consequently, the droplets will not be registered to the same location on the receiver and a loss of image sharpness will occur, which is particularly evident in the printing of text. Therefore, it can be seen that there is an opportunity to provide an improvement to continuous ink jet printers. The features of low-power and low-voltage print head operation are desirable to retain, while providing high-speed printing, without a loss of image sharpness.

SUMMARY OF THE INVENTION

An object of the present invention is to provide for improved droplet placement in printers with print heads in which heat pulses are used to break up fluid into drops having a plurality of volumes, and which use a gas flow to separate the drops along printing and non-printing paths. This improved registration of printed droplets improves the quality of the image on the receiver media.

According to the present invention, an apparatus for printing an image comprises a print head having a group of nozzles from which streams of ink droplets are emitted. A mechanism is associated with each nozzle and is adapted to independently adjust the volume of the ink droplets emitted by the nozzle. Generally, two ranges of drop volumes are created at a given nozzle, with the first having a substantially smaller volume than the second. A droplet deflector is adapted to produce a force on the emitted droplets, said force being applied to the droplets at an angle with respect to the stream of ink droplets to cause ink droplets having the first volumes to move along a first set of paths, and ink droplets having the second volumes to move along second set of paths. An ink catcher is positioned to allow drops traveling along the first set of paths to move unobstructed past the catcher, while intercepting drops traveling along the second set of paths.

According to a feature of the present invention, an ink droplet forming mechanism is provided which is capable of slightly altering the size of the droplets having the first volumes, such that the droplet paths to the receiver are varied in a manner so that the printing droplets, corresponding to the printing of a line of image data, all strike the image receiver at the same point in the fast-scan printing direction.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

Figure 1:
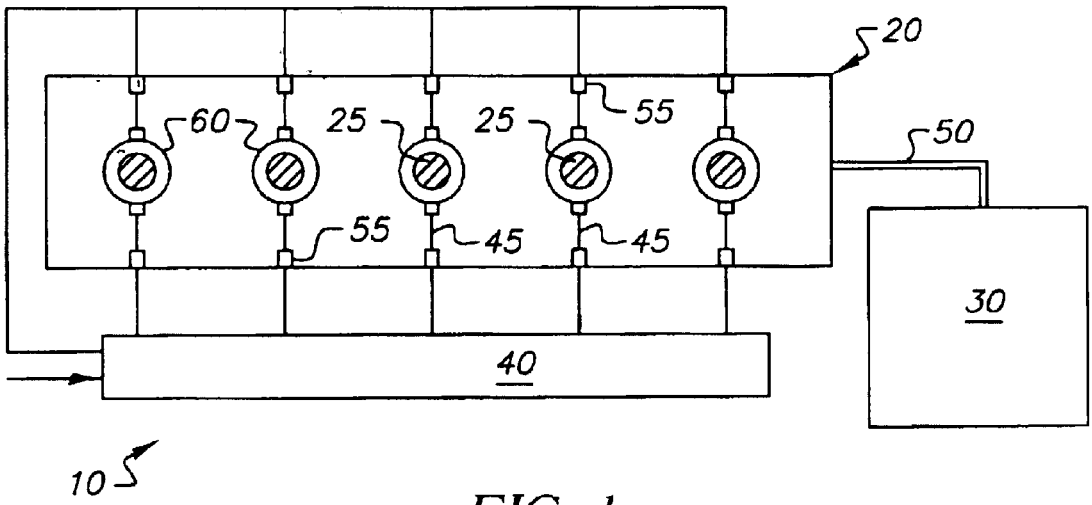
FIG. 1 is a schematic plan view of a print head made in accordance with a preferred embodiment of the present invention.

The present description will be directed in particular to elements forming part of, or cooperating more directly with, apparatus in accordance with the present invention. It is to be understood that elements not specifically shown or described may take various forms well known to those skilled in the art. Like reference numerals designate kike components throughout all of the figures.

FIG. 1 shows an ink droplet forming mechanism 10 of a preferred embodiment of the present invention, including a print head 20, at least one ink supply 30, and a controller 40. Although ink droplet forming mechanism 10 is illustrated schematically and not to scale for the sake of clarity, one will be able to readily determine the specific size and interconnections of the elements of a practical apparatus according to a specific desired application.

In a preferred embodiment of the present invention, print head 20 is formed from a semiconductor material, such as for example silicon, using known semiconductor fabrication techniques (CMOS circuit fabrication techniques, microelectro mechanical structure (MEMS) fabrication techniques, etc.). However, print head 20 may be formed from any materials using any fabrication techniques conventionally known in the art.

A row of nozzles 25 is formed on print head 20. Nozzles 25 are in fluid communication with ink supply 30 through ink passage 50, also formed in print head 20. Single color printing, such as so-called black and white, may be accomplished using a single ink supply 30 and a single set of nozzles 25. In order to provide color printing using two or more ink colors, print head 20 may incorporate additional ink supplies in the manner of supply 30 and corresponding sets of nozzles 25.

A set of heaters 60 is at least partially formed or positioned on print head 20 around corresponding nozzles 25. Although heaters 60 may be disposed radially away from the edge of corresponding nozzles 25, they are preferably disposed close to corresponding nozzles 25 in a concentric manner. In a preferred embodiment, heaters 60 are formed in a substantially circular or ring shape. However, heaters 60 may be formed in a partial ring, square, etc. Heaters 60 in a preferred embodiment consist principally of an electric resistive heating element electrically connected to electrical contact pads 55 via conductors 45.

Conductors 45 and electrical contact pads 55 may be at least partially formed or positioned on print head 20 to provide an electrical connection between controller 40 and heaters 60. Alternatively, the electrical connection between controller 40 and heaters 60 may be accomplished in any well-known manner. Controller 40 is typically a logic controller, programmable microprocessor, etc. operable to control many components (heaters 60, ink droplet forming mechanism 10, etc.) in a desired manner.

Figure 2:
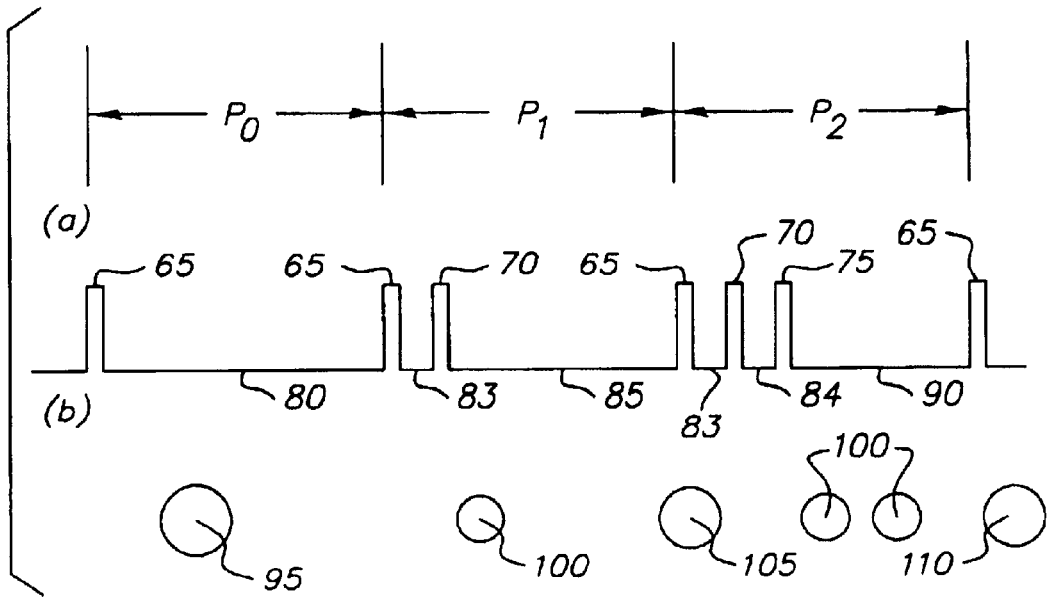
FIG. 2 is a diagram illustrating frequency control of a heater.

FIG. 2 is a schematic example of the electrical activation waveform provided by controller 40 to heaters 60. In general, rapid pulsing of heaters 60 forms small ink droplets, while slower pulsing creates larger drops. In the example presented here, small ink droplets are to be used for marking the image receiver, while larger, non-printing droplets are captured for ink recycling.

In this example, multiple drops per nozzle per image pixel are created. Periods $P_0$, $P_1$, $P_2$, etc. are the times associated with the printing of associated image pixels, the subscripts indicating the number of printing drops to be created during the pixel time. The schematic illustration shows the drops that are created as a result of the application of the various waveforms. A maximum of two small printing drops is shown for simplicity of illustration, however, the concept can be readily extended to permit a larger maximum count of printing drops.

In the drop formation for each image pixel, a non-printing large drop 95, 105, or 110 is always created, in addition to a selectable number of small, printing drops. The waveform of activation of heater 60 for every image pixel begins with electrical pulse time 65. The further (optional) activation of heater 60, after delay time 83, with an electrical pulse 70 is conducted in accordance with image data wherein at least one printing drop 100 is required as shown for interval $P_1$. For cases where the image data requires that still another printing drop be created as in interval $P_2$, heater 60 is again activated after delay 84, with a pulse 75. Heater activation electrical pulse times 65, 70, and 75 are substantially similar, as are all delay times 83 and 84. Delay times 80, 85, and 90 are the remaining times after pulsing is over in a pixel time interval P and the start of the next image pixel. All small, printing drops 100 are the same volume. However, the volume of the larger, non-printing drops 95, 105 and 110 varies depending on the number of small drops 100 created in the preceding pixel time interval P; as the creation of small drops takes mass away from the large drop during the pixel time interval P. The delay time 90 is preferably chosen to be significantly larger than the delay times 83, 84 so that the volume ratio of large non-printing drops 110 to small printing drops 100 is a factor of about 4 or greater.

Figure 3:
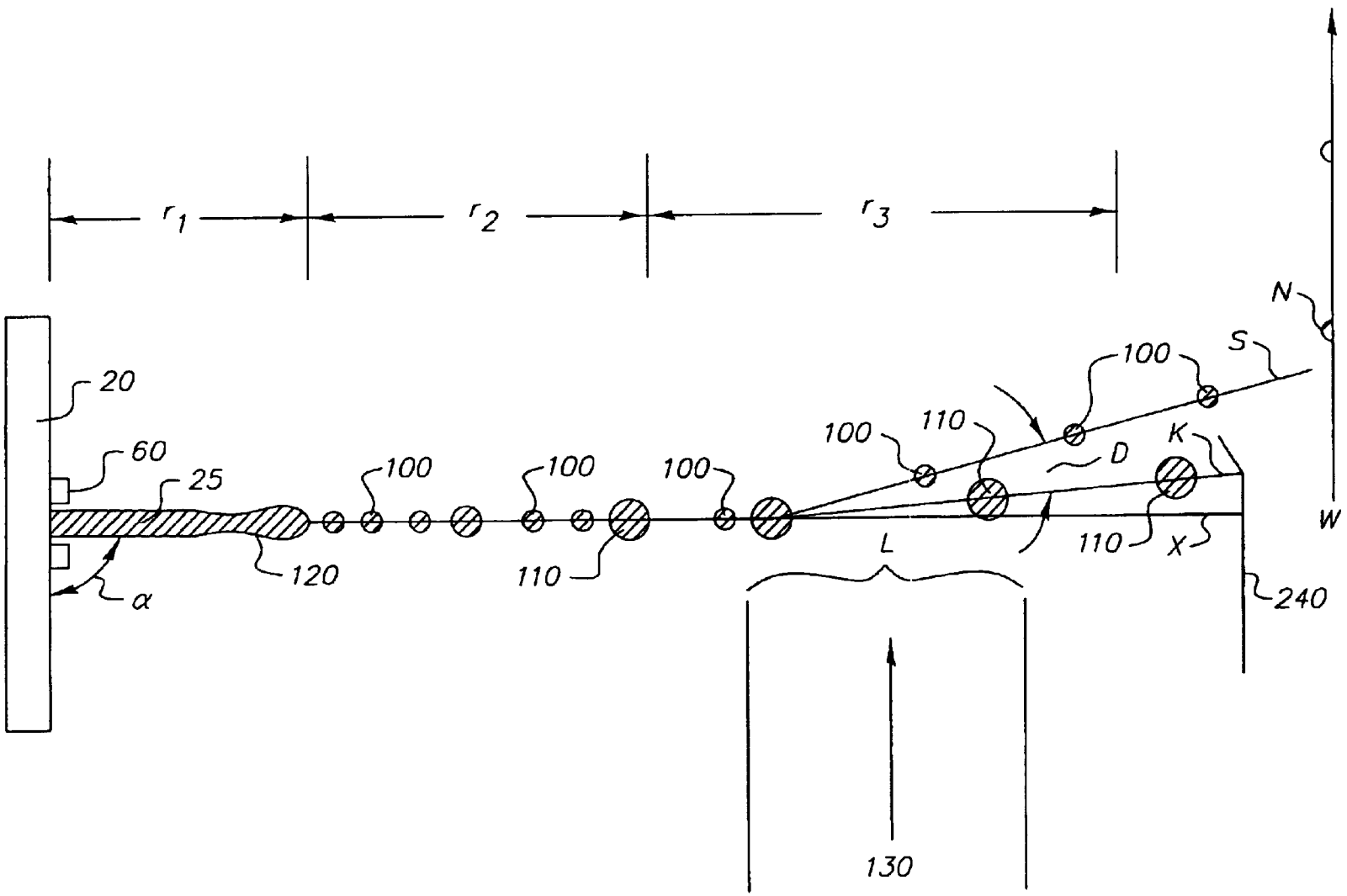
FIG. 3 is a cross-sectional view of an ink jet print head made in accordance with the heater frequency control of FIG. 2.

Referring to FIG. 3 as a schematic example of the operation of print head 20 in a manner such as to provide one printing drop per pixel, as described above, is coupled with a gas-flow discriminator which separates droplets into printing or non-printing paths according to drop volume. Ink is ejected through nozzles 25 in print head 20, creating a filament of working fluid 120 moving substantially perpendicular (angle $\alpha$=90°) to print head 20 along axis X. The physical region over which the filament of working fluid is intact is designated as $r_1$. Heaters 60 are selectively activated at various frequencies according to image data, causing filaments of working fluid 120 to break up into streams of individual ink droplets. Coalescence of drops often occurs in forming non-printing drops 110. This region of jet break-up and drop coalescence is designated as $r_2$.

Following region $r_2$, drop formation is complete in a region $r_3$, and small printing drops and large non-printing drops are spatially separated. A discriminator 130 is provided by a gas flow at a non-zero angle with respect to axis X. For example, the gas flow may be perpendicular to axis X. Discriminator 130 acts over distance L, which is less than or equal to distance $r_3$. Large, non-printing drops 110 have greater masses and more momentum than small volume drops 100. As gas force from discriminator 130 interacts with the stream of ink droplets, the individual ink droplets separate, depending on individual volume and mass. The gas flow rate can be adjusted to provide sufficient deviation D between the small droplet path S and the large droplet paths K, thereby permitting small drops 100 to strike print media W at location N, while large, non-printing drops 110 are captured by a ink guttering structure described below.

Figure 4:
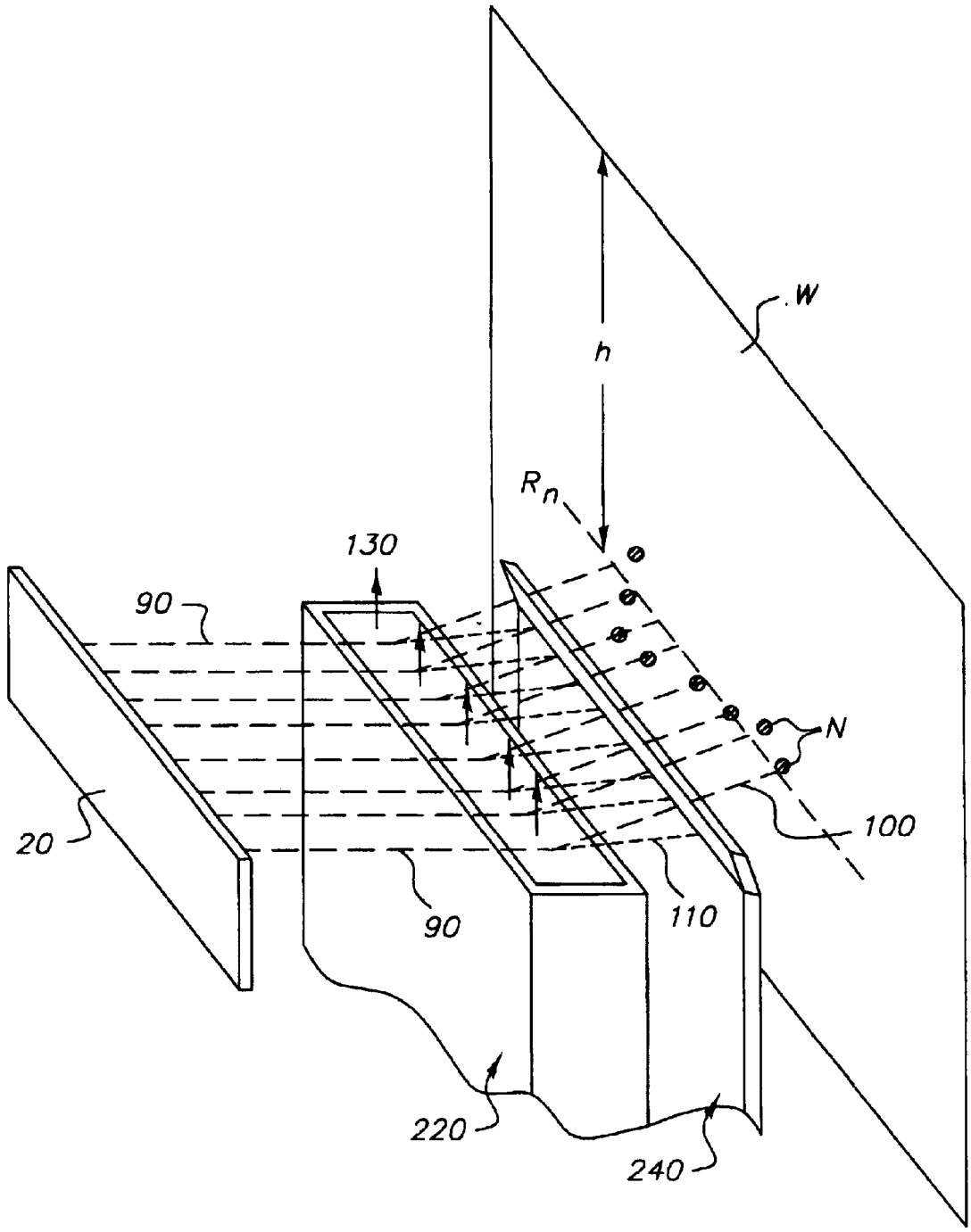
FIG. 4 is a cross-sectional view of a printer, illustrating operation of the ink jet print head of FIGS. 1–3 without actuation of a drop volume adjustment procedure according to the present invention.

FIG. 4 is a schematic illustrating the problem overcome by the present invention. Print head 20, operated in a manner such as to provide one printing drop per pixel as described above, is coupled with a gas-flow discriminator 130 which separates droplets into printing or non-printing paths according to drop volume. Large, non-printing drops 110 are captured by gutter 240, while small, printing drops 100 are allowed to strike image receiver W. Because of design and/or manufacturing tolerances, angle $\alpha$ (as shown in FIG. 3) may be either less than or greater than 90° and may have a different value from jet to jet in printhead 20, while gas-flow force from discriminator 130 may vary in magnitude across plenum 220. The net effect of these sources of variation is that printing droplets 100 associated with a pixel row of the image data, strike the image receiver W at locations N which deviate from the desired print location designated by line $R_n$.

Figure 5:
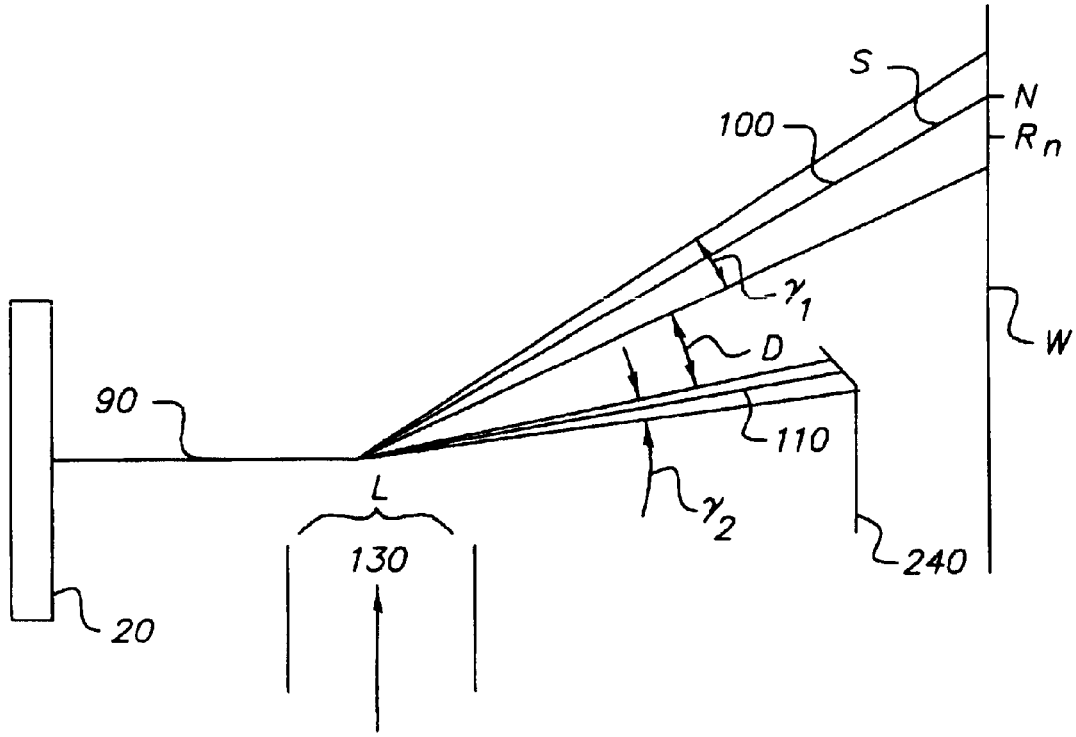
FIG. 5 is a schematic plan of a printer operation in accordance with the drop volume adjustment of the present invention.

A preferred embodiment of the current invention is now described in part by FIG. 5 which is a side-view schematic of a printer. Droplet streams 90, consisting of large and small ink droplets are ejected from printhead 20. These streams interact over distance L with a gas-flow separation force from discriminator 130 such that small droplets are deflected along paths S and large drops are deflected along path K. Small droplets 100 are allowed to strike the image recording media W, while large droplets 110 are captured by gutter 240. Referring again to FIG. 2, the volume of the small printing droplets 100 can be adjusted by changing the time interval 83 between heater activations 65 and 70 in the case of one printing droplet per image pixel, or intervals 83 and 84 identically for the case of two printing droplets per pixel. Reducing the time intervals will decrease the droplet size, and conversely, increasing the time intervals will increase the drop volume. This can be extended in a like manner to cover any larger numbers of small droplets per image pixel. A range of time intervals 83 and 84 is selected so that when the intervals are varied to span this range, small droplet paths S will correspondingly span a range $\gamma_1$. If the time associated with printing a pixel $P_n$, remains constant, the volume of the large non-printing droplets will also vary, and span the range designated by $\gamma_2$. The range of variation in time intervals 83 and 84 is chosen to be sufficiently small that an adequate separation D remains between small droplet paths S and large droplet paths K, so that small, printing droplets 100 do not strike the gutter and conversely, large non-printing droplets 110 do not strike the image receiver W. By adjusting time intervals 83 and 84 of heater activation independently for each nozzle on printhead 20, the position of the impact of the printing droplets on the image receiver N coincides with the target location $R_n$.

Figure 6:
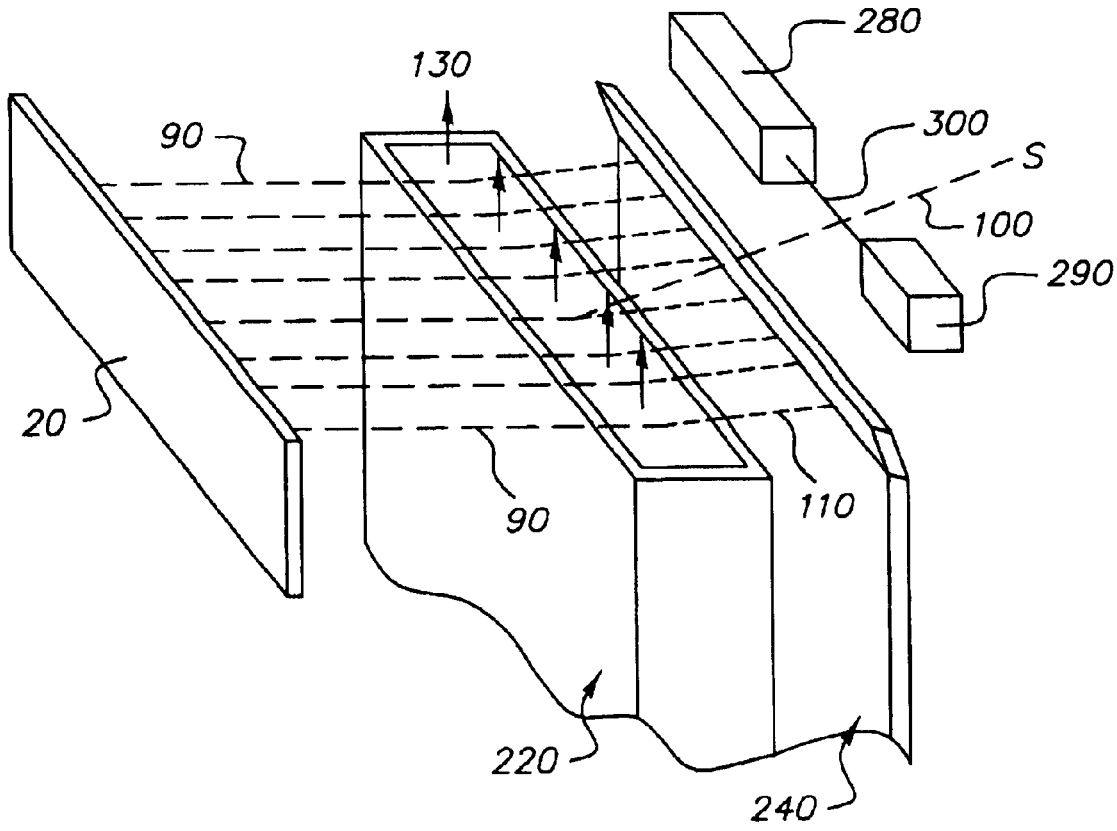
FIG. 6 is a cross-sectional view of a printer operation in accordance with a drop path measurement of the present invention.

Another aspect of the present invention is the determination of the error in the location of the impact point N of the printing droplets on the receiver relative to the target line $R_n$. For this measurement, the printhead is moved to a location adjacent to the image receiver W. This location may also contain a printhead capping or maintenance station. A schematic diagram of the printer at this location is given in FIG. 6. In addition to the printing mechanism, there is provided a laser diode light source 280, with associated light beam 300, that strikes photodiode 290. Light beam 300 is positioned the same distance from printhead 20 as is the image receiver during the printing operation. Printhead 20 is activated to selectively produce a single stream of printing droplets 100 from a first nozzle. Controller 40 adjusts the time intervals 83 and 84 to a minimum value, so that the smallest printing drops 100 are created. In this case, small droplet path S passes above the location of light beam 300. Controller 40 then increases the time intervals 83 and 84 until the small droplet path intersects light beam 300 and reduces the light intensity seen by photodiode 290. The time interval value at which this occurs is stored in a table in controller 10 for use during the printing of image data. This measurement cycle is repeated for each nozzle on the printhead in sequence, so a unique timing value is stored in the table for each nozzle.

Alternatively, the monitoring of the trajectory path of the ink droplets provided by the plural nozzles 5 may be attained by allowing the ink droplets provided by the plural nozzles 25 to actually impact the print medium W after they have passed through discriminator 130 and observing the position of impact of the ink. This method is less preferred due to the fact it is harder to incorporate into automatic printer operation without operator intervention.

It is intended that the combined operation of the adjustment of droplet impact position be made regularly as a part of normal printer operation. For example, the interval table in controller 40 could be updated at the end of every printhead maintenance cycle. It is also envisioned that periodically a measurement of jet location could be carried out, and that if the time intervals 83 and 84 do not lie between preset minimum and maximum values, an error condition could be set which might trigger a more extensive printhead cleaning or maintenance operation.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. An apparatus for printing an image on a recording medium comprising:

a print head including one or more nozzles from which a stream of ink droplets is emitted, the stream of ink droplets including a first plurality of droplets each having a first volume and a second plurality of droplets each having a second volume, the second volume being substantially larger than the first volume;

a heater associated with each nozzle that is capable of adjusting the first volume in proportion to a first pulse time interval between successive heating pulses of the heater, and adjusting the second volume in proportion to a second pulse time interval between successive heating pulses of the heater; and a droplet deflector adapted to produce a force on the emitted droplets, the force being applied to the first plurality of ink droplets and the second plurality of ink droplets at an angle with respect to the stream of ink droplets causing the first plurality of ink droplets to move along a first set of paths to the recording medium, and the second plurality of ink droplets to move along a second set of paths to be intercepted by a catcher prior to reaching the recording medium;

a controller adapted to independently adjust the first time interval for each nozzle thereby adjusting the first volume of each of the first plurality of droplets emitted by a selected nozzle so that the path of the first plurality of droplets emitted by a selected nozzle is altered as a result of the force and the adjusted first volume.

2. An apparatus as set forth in claim 1 wherein:

the controller is responsive to a determination of the path of the first plurality of ink droplets emitted from the selected nozzle.

3. An apparatus as set forth in claim 1 further comprising:

a measurement device adapted to determine the location of the ink drops moving along the first set of paths.

4. An apparatus as set forth in claim 3 wherein:

the measurement device includes a light beam generator and a receptor adapted to detect a location for each of the first set of paths.

5. An apparatus as set forth in claim 3 wherein:

the measurement device includes a light beam generator and a receptor adapted to detect a trajectory for each of the first set of paths.

6. An apparatus for printing an image on a recording medium comprising:

a print head including one or more nozzles from which a stream of ink droplets is emitted, the stream of ink droplets including a first plurality of droplets each having a first volume and a second plurality of droplets each having a second volume, the second volume being substantially larger than the first volume;

a droplet deflector adapted to produce a force on the emitted droplets, the force being applied to the first plurality of ink droplets and the second plurality of ink droplets at an angle with respect to the stream of ink droplets causing the first plurality of ink droplets to move along a first set of paths to the recording medium, and the second plurality of ink droplets to move along a second set of paths to be intercepted by a catcher prior to reaching the recording medium; and a controller adapted to independently adjust the first volume of each of the first plurality of droplets emitted by a selected nozzle so that the path of the first plurality of droplets emitted by a selected nozzle is altered as a result of the force and the adjusted first volume.

7. An apparatus as set forth in claim 6 further comprising:

a heater associated with each nozzle that is capable of adjusting the first volume in proportion to a first pulse time interval between successive heating pulses of the heater, and adjusting the second volume in proportion to a second pulse time interval between successive heating pulses of the heater, the controller adapted to independently adjust the first time interval for each nozzle thereby adjusting the first volume of each of the first plurality of droplets emitted by a selected nozzle.

8. An apparatus as set forth in claim 7 further comprising:

a measurement device adapted to determine the location of the ink drops moving along the first set of paths.

9. An apparatus as set forth in claim 8 wherein:

the measurement device includes a light beam generator and a receptor adapted to detect a location for each of the first set of paths.

10. An apparatus as set forth in claim 8 wherein:

the measurement device includes a light beam generator and a receptor adapted to detect a trajectory for each of the first set of paths.

11. A process for printing images with a print head having at least one nozzle, the process comprising the steps of:

emitting a stream ink droplets from the at least one nozzle, each stream of ink droplets including a first plurality of ink droplets each having a first volume that is adjustable within a first range, and a second plurality of ink droplets each having a second volume that is adjustable within a second range, the second volume being substantially greater than the first volume, the first plurality of ink droplets emitted from a selected nozzle of the at least one nozzle following a first path to strike an image receiver at a print location;

intercepting the second plurality of droplets moving along a second path before reaching the image receiver;

applying a force on the stream of ink droplets at an angle with respect to the stream of ink droplets;

controlling the print location of the first plurality of ink droplets emitted from the selected nozzle by adjusting the first volume ink droplets emitted from the selected nozzle.

12. A process as recited in claim 11, the adjusting step comprising the steps of:

providing pulsed intervals of heat at each nozzle, the first volume of ink droplets being in proportion to a pulse time interval between successive heating pulses; and adjusting the pulse time interval between successive heating pulses at the selected nozzle.

13. A process as recited in claim 12 further comprising the step of:

measuring the location of the ink droplets moving along the first path.

14. A process as recited in claim 13 wherein:

the measuring step is performed with a light beam generator and a receptor adapted to detect a location for each of the first path.

15. A process as recited in claim 13 wherein:

the measuring step is performed with a light beam generator and a receptor adapted to detect a trajectory for each of the first set of paths.

16. A process for printing images with a print head having at least one nozzle, the process comprising the steps of:

emitting a stream ink droplets from the at least one nozzle, each stream of ink droplets including a first plurality of ink droplets each having a first volume that is adjustable within a first range, and a second plurality of ink droplets each having a second volume that is adjustable within a second range, the second volume being substantially greater than the first volume, the first plurality of ink droplets emitted from the at least one nozzle following a first set of paths to strike an image receiver at a respective print location;

intercepting the second plurality of droplets moving along a second set of paths before reaching the image receiver;

applying a force on the stream of ink droplets emitted from the at least one nozzle at an angle with respect to the stream of ink droplets;

controlling the respective print locations of the first plurality of ink droplets emitted from each of the at least one nozzle by allowing for the independent adjustment of the first volume of ink droplets emitted from each of the at least one nozzle.

17. A process as recited in claim 16, the controlling step comprising the steps of:

providing pulsed intervals of heat at each of the at least one nozzle, the first volume of ink droplets emitted from each of the at least one nozzle being in proportion to a pulse time interval between successive heating pulses; and adjusting the pulse time interval between successive heating pulses provided to selected ones of the at least one nozzle.

18. A process as recited in claim 17 further comprising the step of:

measuring the location of the ink droplets moving along the first set of paths.

19. A process as recited in claim 17 wherein:

the measuring step is performed with a light beam generator and a receptor adapted to detect a location for each of the first paths.

20. A process as recited in claim 17 wherein:

the measuring step is performed with a light beam generator and a receptor adapted to detect a trajectory for each of the first set of paths.

* * * * *